US006157306A

United States Patent [19]

Mularoni

[11] Patent Number: 6,157,306

[45] Date of Patent: Dec. 5, 2000

[54] HUMIDITY SENSING SYSTEM FOR A STORAGE CONTAINER

[75] Inventor: Marco Mularoni, Phoenix, Ariz.

[73] Assignee: Nuventions, Inc., Phoenix, Ariz.

[21] Appl. No.: 09/327,005

[22] Filed: Jun. 7, 1999

[51] Int. Cl.[7] ..... G08B 21/00

[52] U.S. Cl. ..... 340/602; 340/584; 340/586; 73/25.04; 73/29.01; 206/204; 206/242; 312/31

[58] Field of Search ..... 340/602, 584, 340/585, 586, 588, 589, 603; 73/25.01, 25.04, 29.01, 29.04; 200/61.06; 236/44 R, 91 A; 206/204, 205, 213.1, 242; 312/31

[56] References Cited

U.S. PATENT DOCUMENTS

| | | | |
|---|---|---|---|
| 4,114,090 | 9/1978 | Poskitt | 324/667 |
| 5,208,162 | 5/1993 | Osborne et al. | 436/6 |
| 5,556,579 | 9/1996 | Newman | 261/99 |
| 5,975,288 | 11/1999 | Crowder et al. | 206/205 |

*Primary Examiner*—Edward Lefkowitz
*Attorney, Agent, or Firm*—Joseph H. Roediger; Gregory Nelson

[57] ABSTRACT

A humidity sensing device dimensioned to be received in a humidor for detecting an out of range ambient moisture condition and transmitting a signal to a remote monitor. The sensing device establishes an acceptable range of period for a humidity sensitive oscillator. The out of range condition causes a signal to be transmitted to the decoding monitor which provides an alarm signal.

14 Claims, 2 Drawing Sheets

HUMIDITY SENSING SYSTEM FOR A STORAGE CONTAINER

BACKGROUND

This invention relates to a humidity sensing system for determining when the humidity in a storage container for articles is outside a predetermined range.

The increasing usage of tobacco products, notably cigars, by the general population has generated interest in maintaining the tobacco products in a proper storage environment. The enjoyment of a cigar depends in part on its history. Should the conditions of storage be too moist or too dry, the value of the cigar is diminished often to the point of becoming worthless. As the popularity of use increases, the demand for tobacco products containing specific types of premium tobacco has caused prices to escalate to the point where a box of fine cigars or a container of blended rare pipe tobaccos represent a substantial sum of money. Unlike cigarettes which are normally rapidly consumed, the cigar and pipe user typically buys a quantity of product that is intended to last for an extended period of time. Consequently, attention is directed to the storage conditions of these premium tobacco products.

The maintenance of the moisture content in the ambient environment is the primary concern of the consumer in maintaining the product quality. Since the consumer is unlikely to be in a position to dedicate the time, resources and space required to duplicate the special rooms used by tobacco merchants to control temperature and moisture, the need has arisen for a practical humidity sensing system which is reliable, much less elaborate than the merchant's facility and suitable for home or office use.

One approach to the provision of a user storage container for tobacco products utilizes containers which include water chambers or storage components for water. Means for releasing moisture over a period of time are included as a structural feature of the container. This type of device does not provide an indication of the actual humidity within the container and ceases to function at all when the water-containing element has dispensed its water. One type of storage container for tobacco which relies on the use of a water reservoir extending into the container is shown in U.S. Pat. No. 5,556,579. The ambient moisture supplied to the air within the container of the disclosed device is controlled through mechanical adjustment of shutters overlying passages in the water reservoir. The effectiveness of the arrangement is only determined when the user opens the container to withdraw a stored product. Thus, these devices lack any means to provide an external indication of the true state of the moisture content within the container.

An electronic moisture meter for use in measuring the moisture content of tobacco during processing is disclosed in U.S. Pat. No. 4,114,090. The tobacco passes through or near a double plate capacitor, the capacitance of which is a function of the moisture content of the tobacco. The frequency of an oscillator varies with the changes in capacitance. A frequency to voltage converter is used to generate a digital read out signal for display of the moisture content of the tobacco being processed. The meter is intended for use in a process environment and thus employs relatively large size capacitance as well as being coupled to an external power supply.

Accordingly, the present invention is directed to a humidity sensing system which is suitable for use in monitoring moisture in a container for tobacco products, typically cigars. In addition, the invention operates to sense and transmit an alarm signal from the container should the moisture level move outside a predetermined range. Thus, the system within the container operates from battery power. The operation of the sensor is intermittent to extend the service period of the power source within the container. The sensor is dimensioned to be conformably received in a cigar box for use in connection with an external alarm signaling device.

SUMMARY OF THE INVENTION

The system for sensing humidity in a container and generating an alarm signal when the humidity therein is outside a predetermined range is comprised of two devices, a sensor and an alarm circuit. The sensor is dimensioned for placement in the container and includes a microprocessor programmed to contain stored limits for an acceptable range of the period of a humidity sensitive oscillator. The limits represent the high and low moisture content which can be tolerated for the preservation of a state of freshness for the stored product.

The humidity sensitive oscillator utilizes a capacitor which varies in accordance with the ambient moisture in the container to produce a change in the period of the signal being generated. The microprocessor determines when the interval between zero crossings of the generated signal is greater or lesser than the programmed limits and generates an out of range signal. In addition, the microprocessor provides a periodic signal indicative of normal operation. These signals are used to activate a transmitter which sends a coded signal to an alarm circuit.

The sensor contains a power supply and a monitor circuit for causing a low battery signal to be transmitted. In addition, a manual test circuit is included in the sensor to enable the user to conduct an independent test of the state of the power supply and the alarm circuit.

The sensor is preferably contained within a cylindrical case dimensioned to fit conformably in a cigar box. Thus, the sensor can be placed in a humidor or used in the original cigar box. In the latter case, the opening of the box to break its initial seal and remove the first cigar is followed by placement of the encased sensor in the space created.

The alarm circuit is located external of the tobacco container and includes means for receiving and decoding the signal transmitted by the sensor as well as, an alarm indicator and means for supplying power to the alarm circuit. The alarm signal generator can include an audible alarm and visual indicators, one for indicating out of range humidity and another indicating the normal operating condition and a low battery condition.

The humidity sensing system is programmed via the microprocessor to periodically activate the oscillator and make the out of range determination thereby extending the life of the sensor power supply. The out of range determination is made without requiring the container to be opened which often results in degrading the conditions within the container.

Further features and advantages of the invention will become more readily apparent from the following description of a preferred embodiment when taken in conjunction with the accompanying drawings.

DESCRIPTION OF THE PREFERRED EMBODIMENT

Figure 1:
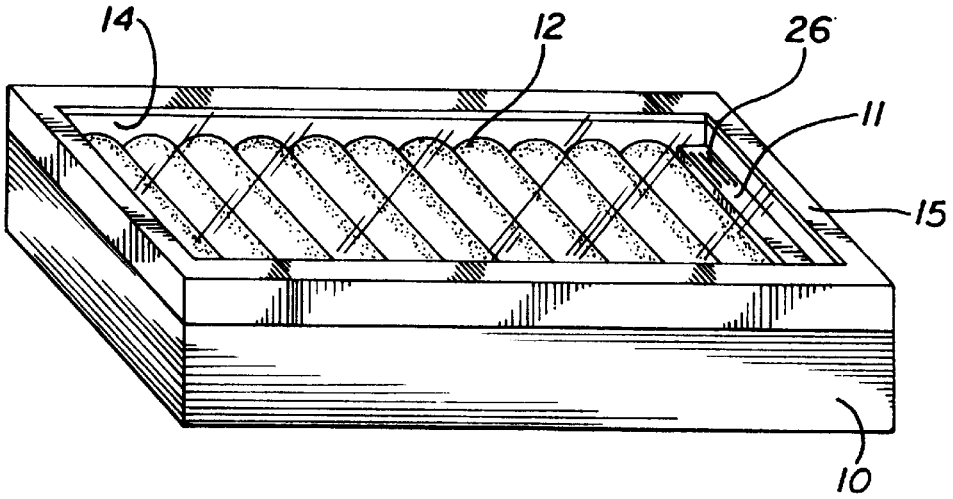
FIG. 1 is a view in perspective showing the sensor positioned in a cigar container.

Referring now to FIG. 1, a cigar container 10 having a transparent window 14 in a hinged cover is shown with sensor 11 aligned with cigars 12. The container may serve as a humidor containing a moisture dispensing device (not shown) or alternatively, may be a substantially moisture-tight container. In each case, the present invention is used to monitor the humidity within the container and generate a signal when the humidity is either above or below the limits of a predetermined range.

The sensor 11 is dimensioned to be conformably received in the container 10 upon removal of the first cigar. Typically, this placement occurs immediately after the opening of a sealed container. In many cases, the cigars are taken from the original container and stored in a humidor having an integral moisture dispensing device. This device may malfunction or become inoperable after exhaustion of the reservoir thereby causing the conditions in the humidor to degrade the cigars. To avoid damaging the stored cigars, the sensor recognizes this state and transmits a signal to an external alarm and indicator circuit.

Figure 2:
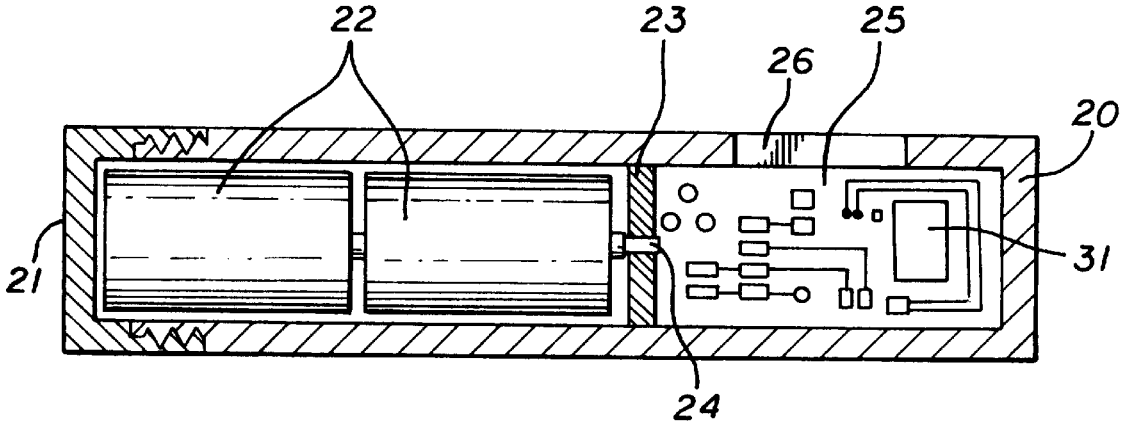
FIG. 2 is a cross section of a preferred embodiment of the sensor showing the placement of the components in the container.

The sensor as shown in FIG. 2 includes a case 20 having a threaded portion 21 which provides access to the batteries 22, insulating spacer 23 with centrally located conductor 24 and circuit board 25 therein. The case 20 contains openings or ventilating slits 26 as seen in FIG. 1 to allow the ambient air in the container 20 to enter the case proximate to the circuit board. The arrangement of the components on the surface of printed circuit board is shown only as a representation and it is to be noted that the circuit layout can be varied with care being taken toz provide an air path between openings 26 and the humidity sensitive capacitor 31 of FIG. 3. The case 20 is made of molded plastic and is preferably molded to the external dimensions of a cigar of average girth.

Figure 3:
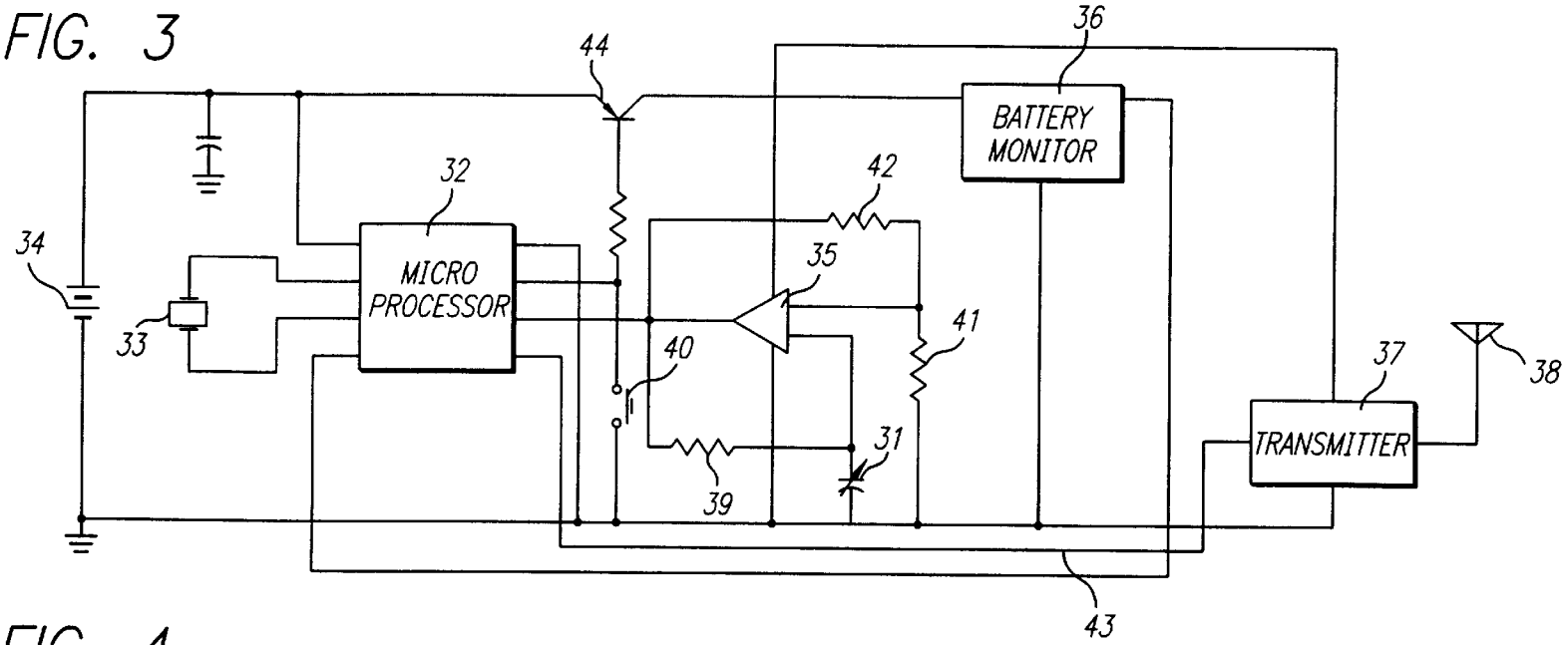
FIG. 3 is a block schematic diagram of the sensor shown in FIG. 2.

The operation of the sensor is described in connection with the electrical block schematic diagram of FIG. 3. The microprocessor 32 which is a Model PIC 12 C5K made by Microchip Technology contains the active components for the oscillator which generates a nominal 4 MHz signal. A 4 MHz crystal is coupled between the two oscillator terminals of the microprocessor. The sensor oscillator signal having a frequency of 6–7 KHz changes in frequency with variations in the impedance of the RC network coupled between input terminals of the microprocessor. The variable capacitor 31 is an air gap capacitor whose dielectric constant varies with the humidity of the air in the gap between plates. The frequency of the sensor oscillator changes accordingly thereby lengthening or shortening the period of the generated signal. The change in capacitance is enhanced by amplifier 35 and provided to the microprocessor.

Microprocessor 32 has the acceptable limits for the humidity range programmed into the memory and calibrated to the periods of the corresponding change frequency. The microprocessor detects the zero crossing of the sensor oscillator signal which departs from the 6–7 KHz signal crossing in accordance with changes in humidity within the container 10. The microprocessor is coupled across the battery 34 and is powered thereby.

When the period of the sensor oscillator signal has changed to the degree that it is outside the predetermined acceptable range, a signal is supplied to the transmitter via connection 43. The signal can also be used to trigger an alarm circuit packaged with the sensor, if desired. When activated, the transmitter sends a signal via antenna 38 to the external alarm circuit of FIG. 4. In addition, the microprocessor can be programmed to periodically activate the transmitter to indicate continuing normal operation by a coded signal via connection 43. Also, the status of power supply 34 is automatically monitored by battery monitor 36. Periodically, a signal from the microprocessor is supplied to the base of transistor 44 thereby placing the monitor across the power supply. A low voltage condition is sensed by monitor 36 and an indicator signal is supplied to microprocessor 32 causing the transmitter 37 to be activated. Similarly, a manually operated switch 40 is provided to take the base of transistor 44 low to verify circuit operation by signal transmission and the activation of the alarm.

The signal from transmitter 37 is received by antenna 50 externally positioned outside container 10. The transmitted signal is a 12 bit code established by microprocessor 32. There are 8 bits used for address and 4 bits for data. The address enables the signal to be distinct from other signals in the same band, for example the signal from garage door openers, which might trigger the alarm circuit of FIG. 4. The 4 data bits indicate the humidity information and the battery condition. Receiver 51 is an integrated circuit receiver, for example a Model MICRFOO1 made by Micrel, which supplies the 12 bit binary bit stream to a decoder 52, for example an HT 120 circuit made by Holtek. The decoder 52 is shown with three output terminals. One terminal provides the base drive signal for transistor 58 which results in the signal from the power supply 59 to appear across the diode 60 and transistor 61 to activate the piezoelectric alarm 54.

Figure 4:
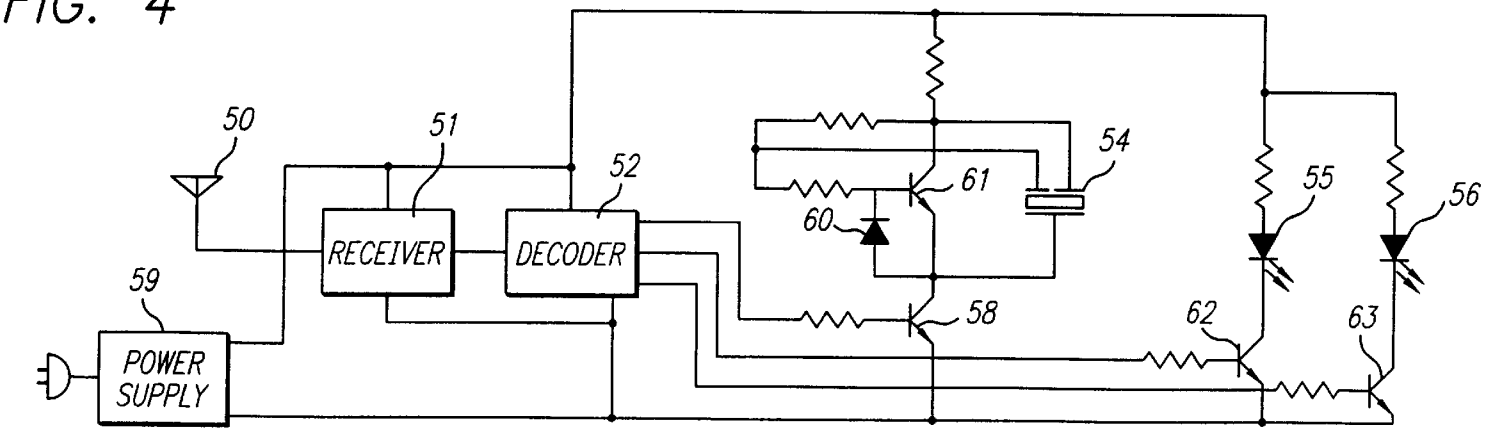
FIG. 4 is a block schematic diagram of the alarm and indicator circuit of a preferred embodiment of the invention.

A second terminal is coupled to the base of transistor 62 which causes LED 55 to emit light when the humidity is out of range. The third terminal of decoder 52 is coupled to transistor 56 which controls LED 56 to indicate the low battery voltage condition. Since the receiver must operate continuously, it is connected to a power supply 59 connected to an ac outlet Preferably, the alarm-indicator circuitry shown in FIG. 4 is incorporated into a module which is mounted on an ac outlet thereby eliminating a power cord.

In operation, the system was programmed to perform the humidity testing and battery monitoring at regular intervals. The acceptable humidity range used is normally 67 to 77 percent relative humidity. The microprocessor is programmed to activate the transmitter 37 after receipt of a plurality of unacceptable measurements to reduce the likelihood of false triggering due to random or transient events.

While the above description has referred to a specific embodiment of the invention, it is to be noted that modifications and variations may be made therein without departing from the scope of the invention as claimed.

What is claim:

1. A system for sensing humidity in a closed container for storing humidity sensitive articles and generating an alarm signal when the absolute humidity therein is outside a predetermined range, said system comprising:

a) a sensor for placement in the closed container, said sensor including:

i) means for generating a periodic signal, the period of said signal being a function of the absolute humidity in said container;

ii) a microprocessor programmed to contain limits to the acceptable range of periods for the predetermined humidity range, said microprocessor generating an out of range signal when the periodic signal is outside the acceptable range;

iii) a transmitter responsive to the out of range signal for transmitting an activating signal;

iv) a power supply for the sensor, and b) an alarm circuit for placement outside the container which includes i) means for receiving the activating signal;

ii) an indicator coupled to the means for receiving and advising that an out of range humidity condition exists within the container, and iii) means for supplying power to the alarm circuit.

2. The system in accordance with claim 1 wherein said means for generating a periodic signal is an oscillator containing a humidity sensitive capacitor.

3. The system in accordance with claim 2 wherein the humidity sensitive capacitor is an air gap capacitor.

4. The system in accordance with claim 3 further comprising a power supply monitor for providing a low-power signal to the microprocessor, said microprocessor activating the transmitter upon receipt of the low-power signal.

5. The system in accordance with claim 4 further comprising a test circuit containing a switch, the activation of the switch providing a test signal to the microprocessor to activate the power supply monitor.

6. The system in accordance with claim 5 wherein said microprocessor generates a coded digital signal upon receiving one of the out of range, low power and test signals, said transmitter sending the coded signal to the alarm circuit.

7. The system in accordance with claim 6 further comprising a case for the humidity sensor, said case being dimensioned to be received in alignment with articles stored in the container.

8. A humidity sensor for placement in a closed container and for transmitting a signal indicating an out of range humidity condition therein to a remote indicator, said sensor comprising:

i) an oscillator circuit for generating a signal having a period which is a function of the absolute humidity in said container;

ii) a microprocessor programmed to contain the upper and lower limits defining the acceptable range of period for the oscillator signal, the microprocessor generating an out of range signal when the period of the oscillator signal is outside the acceptable range;

iii) a transmitter coupled to the microprocessor for sending an activating signal to the remote indicator upon receipt of the out of range signal; and iv) a power supply contained in said sensor.

9. The humidity sensor in accordance with claim 8 wherein the oscillator circuit comprises a humidity sensitive capacitor.

10. The humidity sensor in accordance with claim 9 wherein the humidity sensitive capacitor is an air gap capacitor.

11. The humidity sensor in accordance with claim 10 further comprising a power supply monitor for providing a low power signal to the microprocessor, said microprocessor activating the transmitter upon receipt of the low power signal.

12. The humidity sensor in accordance with claim 11 further comprising a test circuit containing a switch, the activation of the switch providing a test signal to the microprocessor to activate the power supply monitor.

13. The humidity sensor in accordance with claim 12 wherein said microprocessor generates a coded digital signal upon receiving one of the out of range, low power and test signals, said transmitter sending the coded signal to the indicator.

14. The humidity sensor in accordance with claim 13 further comprising a case for the humidity sensor, said case being dimensioned to be received in alignment with articles stored in the container.

* * * * *